United States Patent [19]

Bailey

[11] Patent Number: 4,543,084

[45] Date of Patent: Sep. 24, 1985

[54] BLOOD BAG SUPPORT FOR CENTRIFUGATION

[76] Inventor: Mary L. Bailey, 5543 SE. Oetkin Dr., Milwaukie, Oreg. 97222

[21] Appl. No.: 545,940

[22] Filed: Oct. 27, 1983

Related U.S. Application Data

[63] Continuation-in-part of Ser. No. 320,221, Feb. 9, 1982, abandoned.

[51] Int. Cl.[4] ..... B04B 5/02; B04B 7/00

[52] U.S. Cl. ..... 494/20; 211/59.1; 248/97; 248/153; 494/37

[58] Field of Search ..... 211/59.1, 71; 248/97, 248/153, 311.3, 311.2, 95; 494/16, 17, 18, 19, 20, 21, 37, 45

[56] References Cited

U.S. PATENT DOCUMENTS

| | | | |
|---|---|---|---|
| 1,145,297 | 7/1915 | Erickson et al. | 248/97 |
| 2,235,986 | 3/1941 | Ellingson | 248/153 |
| 2,626,061 | 1/1953 | Girouard | 211/59.1 |
| 3,265,216 | 8/1966 | Samsing | 211/57.1 |
| 3,578,306 | 4/1971 | Grebow | 248/97 |
| 4,098,456 | 7/1978 | Bayham | 494/21 X |
| 4,175,602 | 11/1979 | Cavalaris et al. | 248/97 X |
| 4,295,619 | 10/1981 | Kulin et al. | 248/311.3 X |
| 4,413,773 | 11/1983 | Rohde et al. | 494/20 X |

FOREIGN PATENT DOCUMENTS

| | | | |
|---|---|---|---|
| 399781 | 1/1909 | France | 248/97 |
| 1303386 | 7/1962 | France | 211/59.1 |

*Primary Examiner*—Robert W. Gibson, Jr.
*Attorney, Agent, or Firm*—Glen A. Collett

[57] ABSTRACT

A support for the ports of a blood bag for use in a centrifuge in order to keep the ports upright during centrifugation so that the ports will not trap blood cells which would later contaminate the blood plasma. The support includes a base positionable adjacent to the bottom of a centrifuge cup, an upstanding plate attached to the periphery of the base and extending up adjacent to the side of the cup, and hook means mounted on the top of the plate and extending over the cup for engagement by the port area of the blood bag.

12 Claims, 5 Drawing Figures

BLOOD BAG SUPPORT FOR CENTRIFUGATION

This application is a continuation-in-part of application Ser. No. 320,221, filed Feb. 9, 1982, now abandoned.

BACKGROUND OF THE INVENTION

This invention relates to human blood processing equipment, and in particular to a device for supporting a blood bag during the process of centrifugation.

It is the usual procedure to collect human blood by drawing it into a plastic blood bag. The blood bag is simply a container formed by sealing two sheets of plastic together. Of course, the sheets of plastic bulge as the bag is filled with blood. Tubes are attached to the bag through openings called ports. Often several ports are provided as needed for the later handling or processing of the blood.

One of the principal techniques used in the processing of blood is to centrifuge it to separate out various density fractions. For this, the blood bag is placed in a a centrifuge and spun at an r.p.m. and for a time necessary to cause the separation of the blood cells and plasma.

It is not uncommon in this centrifugation process for the ports on the blood bag to become inverted and retain a portion of the blood so that it does not mix with the remainder of the blood. Consequently, the blood trapped in the ports contains red blood cells which are dumped into the plasma as the blood bag is removed from the centrifuge. This is undesirable since the plasma is then contaminated by small quantities of red blood cells.

Accordingly, it is the general object of the present invention to provide a device which holds the ports of the blood bag upright so that they do not trap a portion of the blood.

Another object is to provide a frame on which the blood bag may be supported as it is placed into and removed from the centrifuge cup.

Still another object is to provide a strong assembly capable of withstanding the high pressures of centrifugation.

A further object is to provide a support which has no sharp edges to damage the blood bag.

Still another object is to provide a simple device which is readily incorporated into currently accepted blood processing procedures.

These and other objects and advantages of the present invention and the manner in which they are achieved will be made apparent as the following specification and claims progress, taken in conjunction with the drawings which illustrate the preferred embodiment.

SUMMARY OF THE INVENTION

In its basic concept, the present invention is a support frame for the ports of a blood bag for use in a centrifuge in order to keep the ports upright during centrifugation. The support includes a base positionable adjacent to the bottom of a centrifuge cup, an upstanding plate attached to the periphery of the base and extending up adjacent to the side of the cup, and hook means mounted on the top of the plate and extending over the cup for engagement by the port area of the blood bag.

DESCRIPTION OF THE PREFERRED EMBODIMENT

The purpose of centrifugation in processing human blood is to separate the blood cells from the plasma. The blood cells are more dense than the plasma and settle at the bottom of the blood bag, while the plasma forms a layer at the top of the blood bag. The plasma can then be decanted to separate the fractions.

Figure 3:
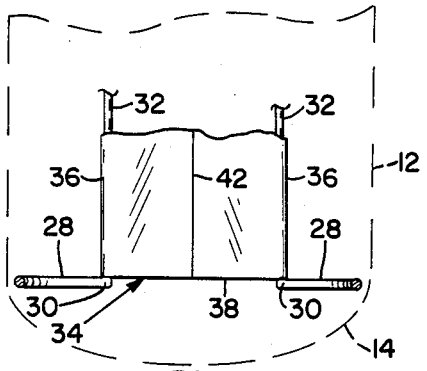
FIG. 3 is a fragmentary section of the blood bag support, taken along the line 3—3 of FIG. 1, illustrating the centrifuge cup in phantom line.
Figure 4:
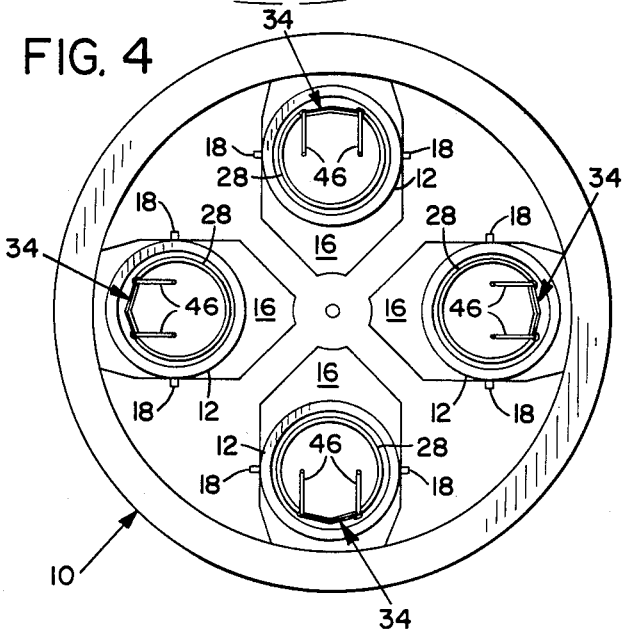
FIG. 4 is a top view of a centrifuge apparatus incorporating four of the blood bag supports of the present invention.
Figure 5:
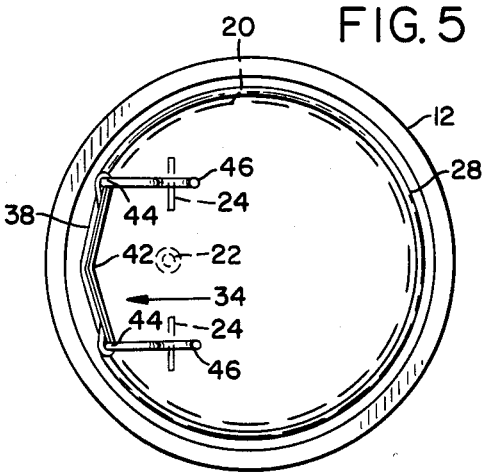
FIG. 5 is an enlarged top view of one of the centrifuge cups of FIG. 4, showing the arrangement of the blood bag support and the blood bag therein prior to centrifugation.

FIG. 4 illustrates a centrifuge, generally at 10. Four centrifuge cups 12 (FIGS. 3–5) are mounted in the centrifuge. Each cup has a rounded bottom 14. An opening 16 in the centrifuge allows the cups to pivot outwardly on pivot points 18 as the centrifuge spins. It can be appreciated that significant G-forces are generated as the centrifuges of this type are often operated at up to five thousand r.p.m..

Figure 1:
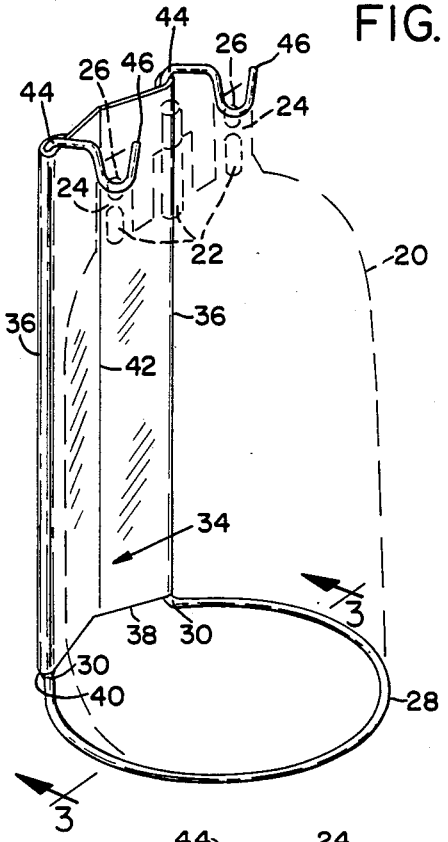
FIG. 1 is a top perspective view of the blood bag support of the present invention, shown mounting a blood bag which is illustrated in phantom line.

FIG. 1 illustrates a blood bag 20, which is simply two sheets of plastic bonded together. As the blood bag is filled, the plastic sheets bulge outwardly to accomodate a volume of blood.

Several ports 22 are located at the top (referring to the direction the blood bag is placed in the centrifuge) of the blood bag. A port is an entrance for a tube, or a place where the blood bag may be spiked in order to draw off a portion of the blood or a blood fraction. At the time of centrifuging, all of the ports are closed. Some of the ports are sterily shielded by port covers 24. These are tabs which cover the port but which may be pulled apart to expose the ports. The port covers are provided with holes 26.

Figure 2:
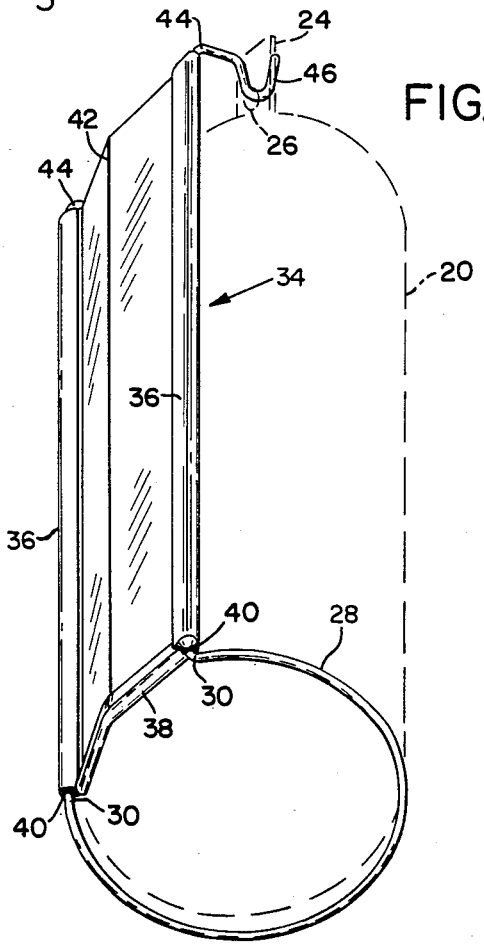
FIG. 2 is a bottom perspective view of the blood bag support of FIG. 1.

FIGS. 1 and 2 illustrate the blood bag support of the present invention. A base is positionable adjacent the bottom of the cup. Preferably, this base is a wire having an arcuate contour and being dimensioned to fit around the interior bottom of the centrifuge cup as shown in FIG. 3. Because the centrifuge cup is circular, this is also preferably the configuration of the base wire.

Preferably, base wire 28 is bent perpendicularly to the base at 30 and extends vertically the height of centrifuge cup 12. Vertical wires 32 (FIG. 3) are parallel and lie adjacent the wall of the centrifuge cup.

An upstanding plate, denoted generally at 34, is attached substantially perpendicularly to the periphery of the base and extends up adjacent the side of the cup. Preferably, the edges of the plate are folded around vertical wires 32 at folds 36. This mounts the plate on the base.

Plate 34 also includes a rounded fold 38 at its bottom. A welded fillet 40 smooths the attachment of the wires to the plate. It can be appreciated that a substantial pressure is placed on the bottom of the bag during centrifuging. The rounded edges of the plate prevent the bag from breaking as it presses against the plate's edges. A similar consideration is also applicable to the round base wire 28.

Plate 34 further has a center crease or bend 42 which extends vertically and which forms the plate to approximate the curvature of the wall of the centrifuge cup. In addition, this strengthens the plate considerably.

The plate has a significant width, and this may be described in the terms that it subtends an arc of between 20° and 90°, preferably about 60° of the circumference of the centrifuge cup. The width of the plate adds strength, but in addition, it is also held upright by a considerable force placed radially on it during the centrifugation.

Hook means are mounted on the top of the plate and extend over the open top of the cup and are configured to engage the ports or port area of the blood bag to hold the ports upright during centrifugation. Preferably, wires 32 are bent at 44 to extend from the top of the plate substantially horizontally over the top of the cup and terminate in upwardly opening U-shaped curves. These form hooks 46 for engaging holes 26 in port covers 24. The hooks are spaced apart a distance substantially equal to the distance between the ports on the blood bag. This holds the port area upright and prevents the ports from folding over and trapping blood during the centrifugation process.

It must be realized that the hooks do not support the entire weight of the blood bag, but only hold the port area upright while the majority of the weight of the blood rests on the bottom of the centrifuge cup.

OPERATION

The full blood bag is attached by its port cover holes 26 to the hooks 46 on the blood bag support. The bottom of the blood bag rests on the base wire 28. This assembly is then placed into the centrifuge cup 12 and the majority of the weight is placed on the bottom 14 of the centrifuge cup.

The centrifuge is then operated at a speed and for a period of time necessary to cause the blood to separate into layers. Centrifuge cups 12 pivot at 18 and are spun to nearly a horizontal angle in the centrifugation process. For purposes of the present discussion, it is understood that the upright or vertical direction, as it has reference to the blood bag or the blood bag support, is in the direction of the top of the centrifuge cup, or opposite the direction of the G-force created by the centrifuge.

The port area is held upright by the hooks and some weight is supported by the hooks, but the majority of the weight is on the bottom of the centrifuge cup. Considerable force is placed against the plate 34 which holds it vertical and does not allow its joint with the base wire 28 to bend.

Upon completion of the centrifugation, the blood bag support and the blood bag are withdrawn from the centrifuge cup. The port covers are gently removed from the hooks. The plasma is in the top layer of the bag, while the blood cells are in the bottom layer. The plasma is then drawn off for further processing, and the same is true of the remaining red blood cells.

Having described my invention in its preferred embodiment, I claim:

1. A blood centrifugation apparatus comprising in combination:

(a) a centrifuge having at least one substantially cylindrical cup, being pivoted to pivot outwardly as the centrifuge spins;

(b) a blood bag for containing blood to be centrifuged, the blood bag having a port area at the top thereof, and having engagable means in the port area for holding it upright; and (c) a blood bag port support including a substantially cylindrical base positionable adjacent the bottom of the cup, an upstanding plate attached substantially perpendicularly to the periphery of the base and extending up adjacent to and substantially conforming to the side of the cup, and hook means mounted on the top of the plate and extending over the top of the cup and being configured to engage the port area of the blood bag to hold the ports upright during centrifugation.

2. The apparatus of claim 1 wherein the plate has a vertical bend which forms the plate to approximate the curvature of the wall of the centrifuge cup.

3. The apparatus of claim 1 wherein the base is substantially circular in configuration and wherein the plate subtends an arc of between 20 degrees and 90 degrees.

4. A blood bag port support for use in a centrifuge having a substantially cylindrical cup in which the blood bag is placed for centrifugation, the support comprising:

(a) a substantially circularly configured base positionable adjacent the bottom of the cup;

(b) a load bearing, upstanding plate attached substantially perpendicularly to the periphery of the base, the plate being bent to conform approximately to the periphery of the base and the curvature of the wall of the centrifuge cup, and extending up adjacent the side of the cup; and (c) hook means mounted on the top of the plate and extending over the top of the cup and being configured to engage the port area of the blood bag to hold the ports upright during centrifugation.

5. The support of claim 4 wherein the base comprises a wire having an arcuate contour and being dimensioned to fit around the interior bottom of the centrifuge cup, and wherein the base wire is bent substantially vertically and extends adjacent the edges of the plate, and wherein the edges of the plate are folded around the vertical wires, and wherein the wires are bent at the top of the plate to extend over the top of the cup and form the hook means.

6. The support of claim 5 further comprising a fillet at the lower edge of the plate at its engagement with the base wire to form a smooth surface.

7. The support of claim 5 wherein the plate has a rounded fold at its bottom to smooth its lower edge.

8. The support of claim 4 wherein the plate subtends an arc of between 20 degrees and 90 degrees.

9. The support of claim 4 wherein the hook means comprises two similar wires, each extending from the top of the plate substantially horizontally over the top of the cup and terminating in an upwardly opening U-shaped curve forming a hook, the hooks being spaced apart a distance substantially equal to the distance between the ports on the blood bag.

10. A method of centrifuging blood in a blood bag, comprising:

(a) placing a port support apparatus in a centrifuge cup, the port support apparatus including a base positioned adjacent the bottom of the cup, a plate attached to the base and extending up adjacent the side of the cup, and hook means mounted on the top of the plate and extending over the top of the cup;

(b) placing a blood bag in the centrifuge cup;

(c) supporting the ports substantially upright by the hook means, while allowing the majority of the weight of the blood to rest on the bottom of the centrifuge cup;

(d) operating the centrifuge; and (e) removing the blood bag from the centrifuge cup.

11. The method of claim 10 further comprising placing the blood bag and the port support apparatus in the centrifuge cup together.

12. The method of claim 10 further comprising removing the blood bag and the port support apparatus from the centrifuge cup together.

* * * * *